US009139359B1

(12) United States Patent
Simpson et al.

(10) Patent No.: US 9,139,359 B1
(45) Date of Patent: Sep. 22, 2015

(54) PACKAGING FOR PROTECTION AND DISPLAY OF TREATS

(71) Applicants: Kip Robert Simpson, Morrison, IL (US); Robert Loren Simpson, Morrison, IL (US); Nathan Eugene Richter, Clinton, IA (US); John Huling, Clinton, IA (US); Connie Susannah Davis, Clinton, IA (US)

(72) Inventors: Kip Robert Simpson, Morrison, IL (US); Robert Loren Simpson, Morrison, IL (US); Nathan Eugene Richter, Clinton, IA (US); John Huling, Clinton, IA (US); Connie Susannah Davis, Clinton, IA (US)

( * ) Notice: Subject to any disclaimer, the term of this patent is extended or adjusted under 35 U.S.C. 154(b) by 0 days.

(21) Appl. No.: 14/459,925

(22) Filed: Aug. 14, 2014

(51) Int. Cl.

| | |
|---|---|
| ***B65D 5/46*** | (2006.01) |
| ***B65D 5/00*** | (2006.01) |
| ***B65D 5/36*** | (2006.01) |
| ***B65D 85/60*** | (2006.01) |
| ***B65D 5/42*** | (2006.01) |
| ***B65D 5/468*** | (2006.01) |
| ***B65D 5/66*** | (2006.01) |

(52) U.S. Cl.
CPC ..... *B65D 85/60* (2013.01); *B65D 5/4204* (2013.01); *B65D 5/4608* (2013.01); *B65D 5/66* (2013.01)

(58) Field of Classification Search
USPC ..... 229/117.15, 125.32; 206/748
See application file for complete search history.

(56) References Cited

U.S. PATENT DOCUMENTS

| | | | | |
|---|---|---|---|---|
| 1,966,734 | A | 7/1934 | Rosen | |
| 3,093,294 | A * | 6/1963 | Kusunoki | 229/117.14 |
| 3,581,974 | A * | 6/1971 | Freeman | 229/110 |
| 4,230,261 | A * | 10/1980 | Austin | 229/117 |
| 4,895,295 | A * | 1/1990 | Montgomery et al. | 294/165 |
| 4,902,519 | A | 2/1990 | Ream et al. | |
| 7,475,804 | B2 * | 1/2009 | Clegg et al. | 229/116.1 |
| 8,087,572 | B2 * | 1/2012 | Kibbe | 229/126 |
| 8,579,183 | B2 * | 11/2013 | Belfort et al. | 229/101 |
| 2007/0000980 | A1 * | 1/2007 | Oliveira | 229/117.15 |
| 2011/0174870 | A1 * | 7/2011 | Owensby et al. | 229/117.12 |

* cited by examiner

*Primary Examiner* — Christopher Demeree

(57) ABSTRACT

A packaging for the protection and display of treats may include a base tray and a container. The base tray may include an upper level panel, at least one middle level panel and a lower level panel. The container may include a first side panel, a second side panel, a front panel, and a rear panel. The base tray and the container may be made by folding each panel to form a closed structure. Securement tabs of the base tray may removably attach to securement holes along the first side panel and the side side panel of the container.

9 Claims, 6 Drawing Sheets

PACKAGING FOR PROTECTION AND DISPLAY OF TREATS

BACKGROUND OF THE INVENTION

The present invention relates to packaging and, more particularly, to packaging and display of treats.

Cake pops, cookies on a stick, push pops, and other treats with sticks look best when presented standing on their stick versus laying flat in their packaging. The product should be completely covered and protected for display and transport, but should still have a way to easily access the treats for consumption. Currently, packaging is often not visually appealing, do not secure the contents in a positive way, or make the contents difficult to easily access.

Multiple packaging elements can increase costs, increase setup time, and make the setup of the packaging difficult. Treats that are placed on a stick are made not only to be eaten, but also to be placed on display. Currently, packaging may display the treats adequately without securing the product properly, or secures the products without proper display of the treats and without proper access.

As can be seen, there is a need for a packaging that protects and displays treats that may be on sticks.

SUMMARY OF THE INVENTION

In one aspect of the present invention, a packaging for the protection and display of treats comprises: a base tray comprising: an upper level panel having a plurality of upper level panel holes, wherein the upper level panel has an upper level panel first side flap and an upper level panel second side flap; at least one middle level panel having a top side and a plurality of middle level panel holes, wherein the top side of the middle level panel has at least one support, wherein the middle level panel connects to the upper level panel by a first intermediate panel; and a lower level panel connected to the upper level panel by a second intermediate panel, wherein the lower level panel comprises a plurality of securement tabs, wherein the secondary intermediate panel comprises a plurality of tab; and a container comprising: a first side panel and a second side panel each having a securement hole, wherein the first side panel and the second side panel each have an upper flap having an upper flap securement hole; a front panel connected to the first side panel and the second side panel, wherein the front panel has a front panel window; a rear panel connected to the second side panel and removably connected to the first side panel, wherein the rear panel has a rear panel window, wherein the securement tabs of the base tray removably attach to the securement holes of the container.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a packaging for the protection and display of treats that may include a base tray and a container. The base tray may include an upper level panel, at least one middle level panel and a lower level panel. The container may include a first side panel, a second side panel, a front panel, and a rear panel. The base tray and the container may be made by folding each panel to form a closed structure. Securement tabs of the base tray may removably attach to securement holes along the first side panel and the side side panel of the container.

Figure 1:
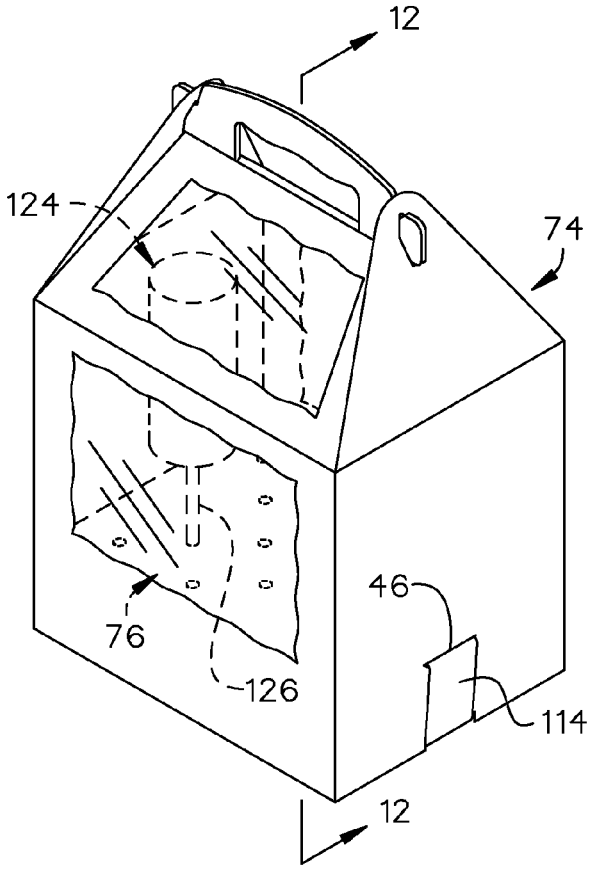
FIG. 1 is a perspective view of an exemplary embodiment of the present invention shown in use.
Figure 2:
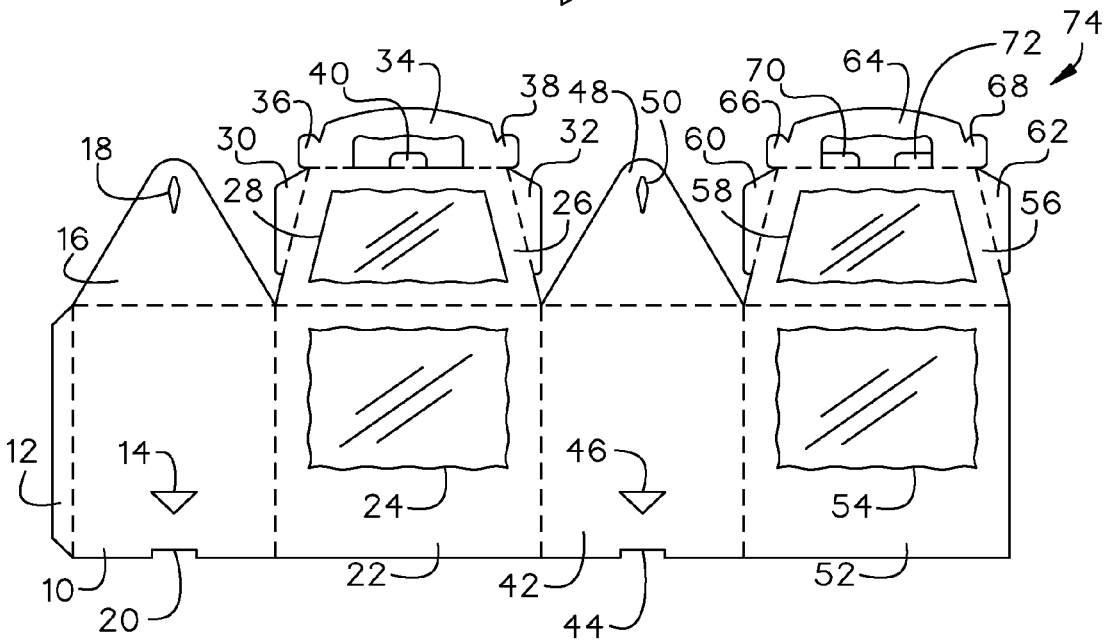
FIG. 2 is a front view of an exemplary embodiment of the present invention shown unfolded.
Figure 3:
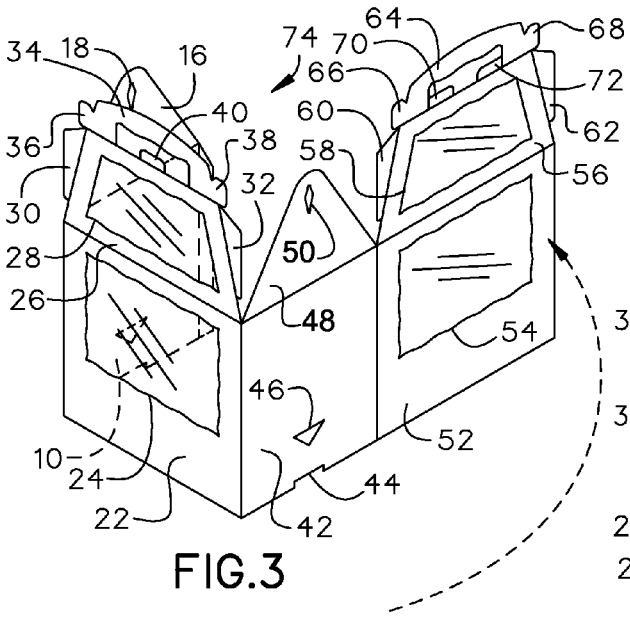
FIG. 3 is a perspective view of an exemplary embodiment of the present invention demonstrating folding configuration.
Figure 4:
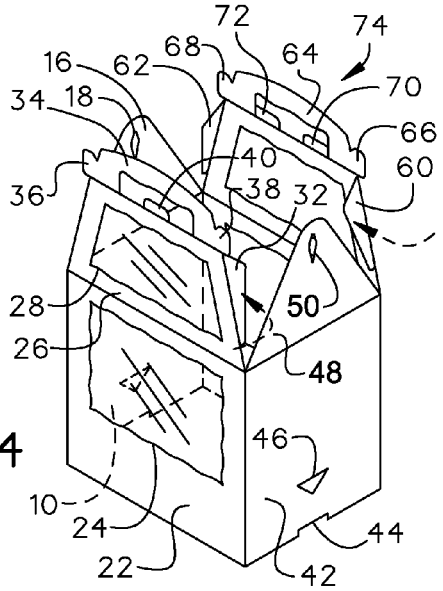
FIG. 4 is a perspective view of an exemplary embodiment of the present invention demonstrating folding configuration.
Figure 5:
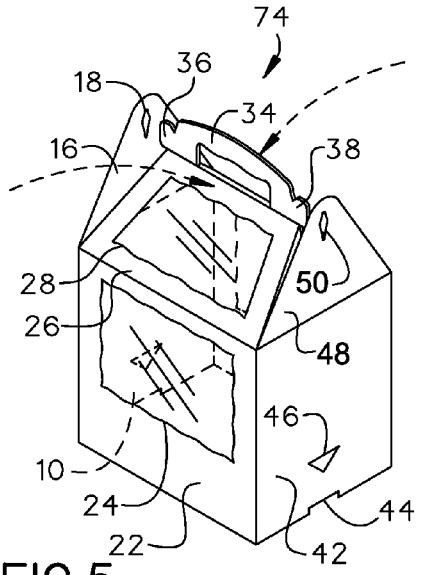
FIG. 5 is a perspective view of an exemplary embodiment of the present invention demonstrating folding configuration.
Figure 6:
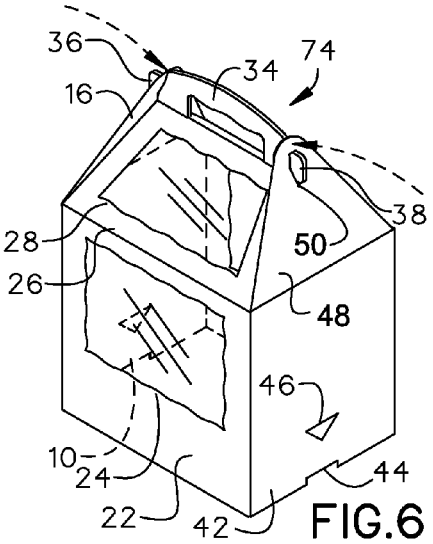
FIG. 6 is a perspective view of an exemplary embodiment of the present invention demonstrating folding configuration.
Figure 7:
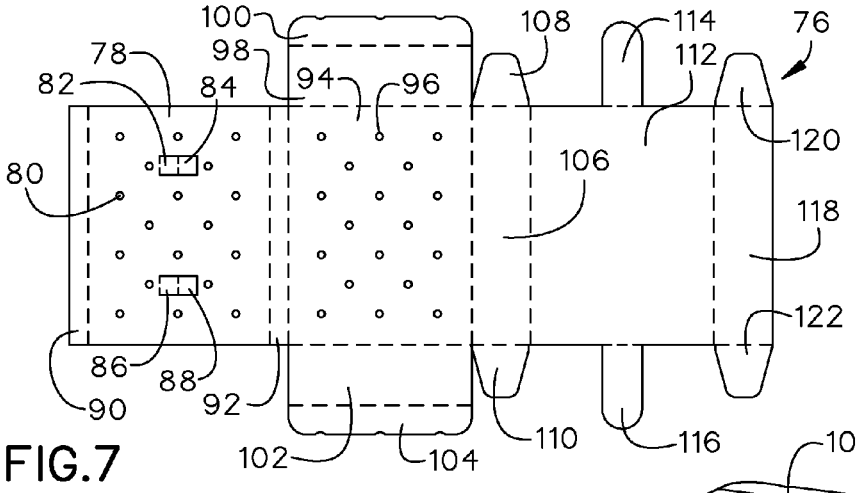
FIG. 7 is a front view of an exemplary embodiment of a tray of the present invention shown unfolded.
Figure 8:
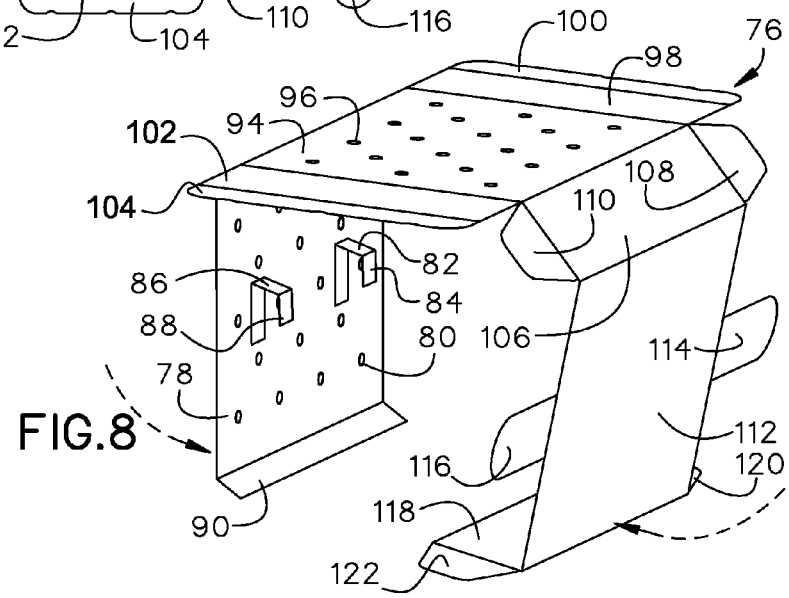
FIG. 8 is a perspective view of an exemplary embodiment the tray of the present invention demonstrating folding configuration.
Figure 9:
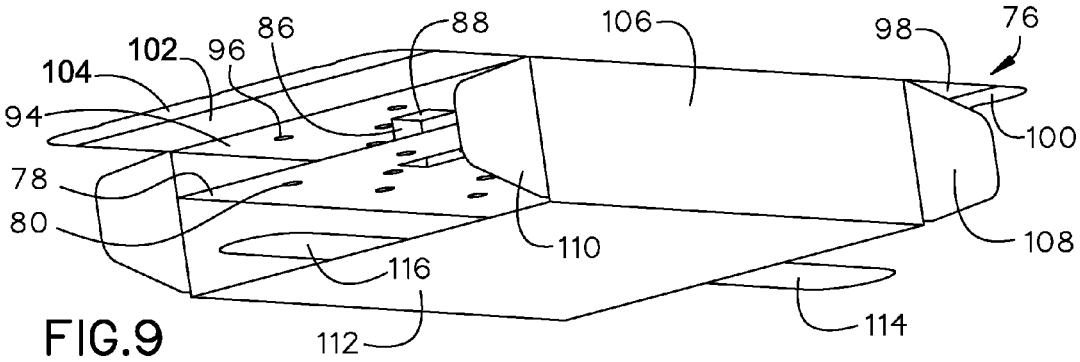
FIG. 9 is a perspective view of an exemplary embodiment of the tray of the present invention demonstrating folding configuration.
Figure 10:
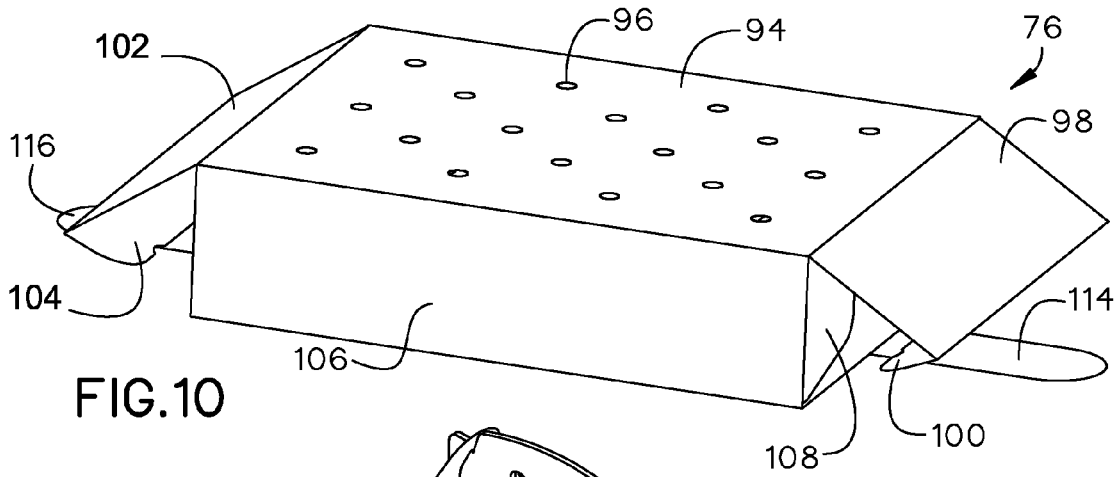
FIG. 10 is a perspective view of an exemplary embodiment of the tray of the present invention demonstrating folding configuration.
Figure 11:
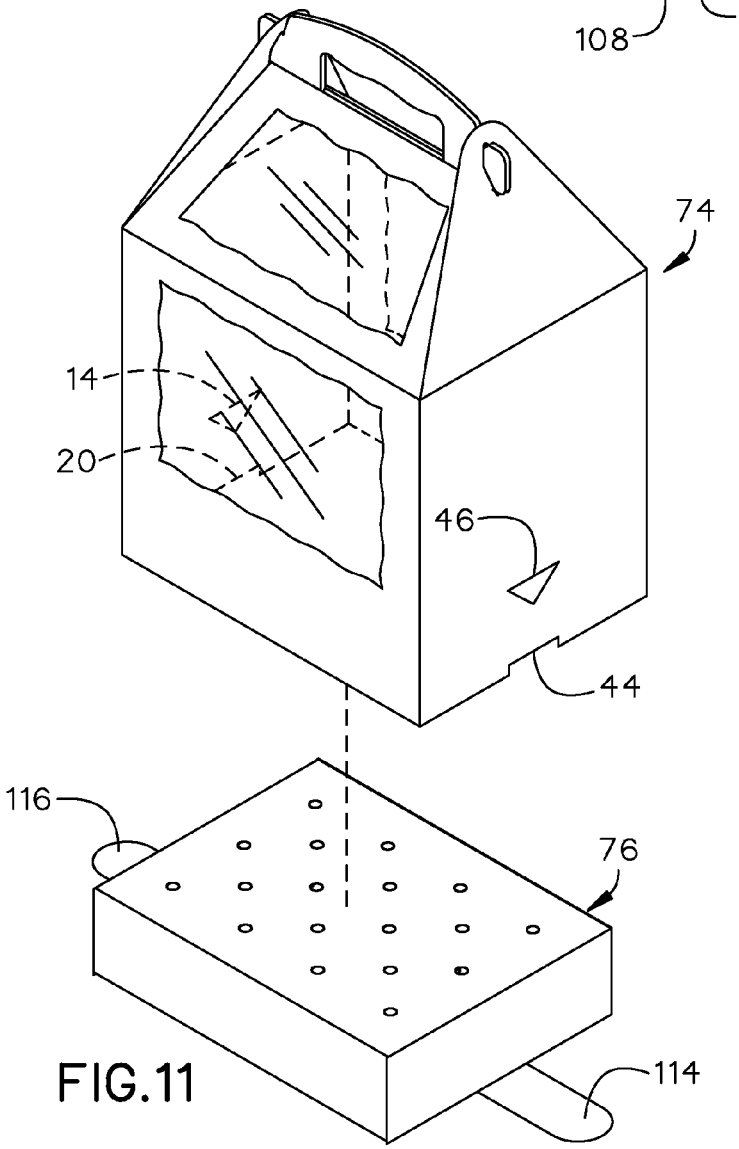
FIG. 11 is an exploded view of an exemplary embodiment of the present invention demonstrating final assembly.
Figure 12:
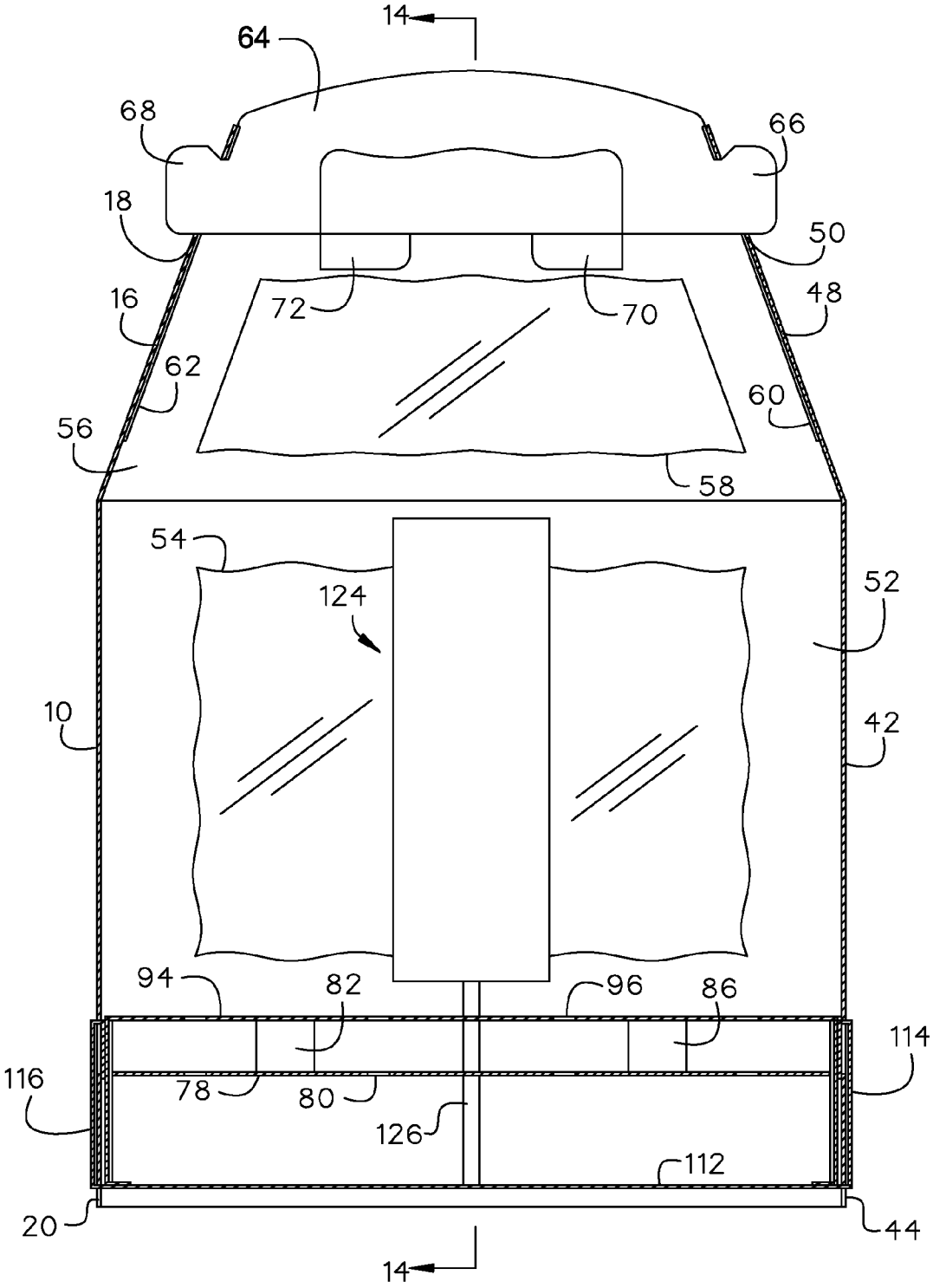
FIG. 12 is a section view of an exemplary embodiment of the present invention along line 12-12 in FIG. 1.
Figure 13:
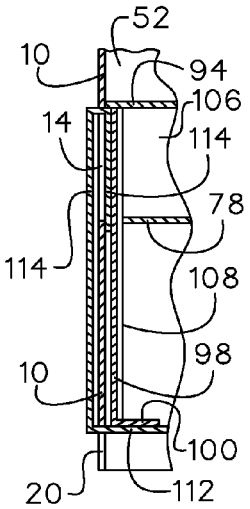
FIG. 13 is a detail section view of an exemplary embodiment of the present invention.
Figure 14:
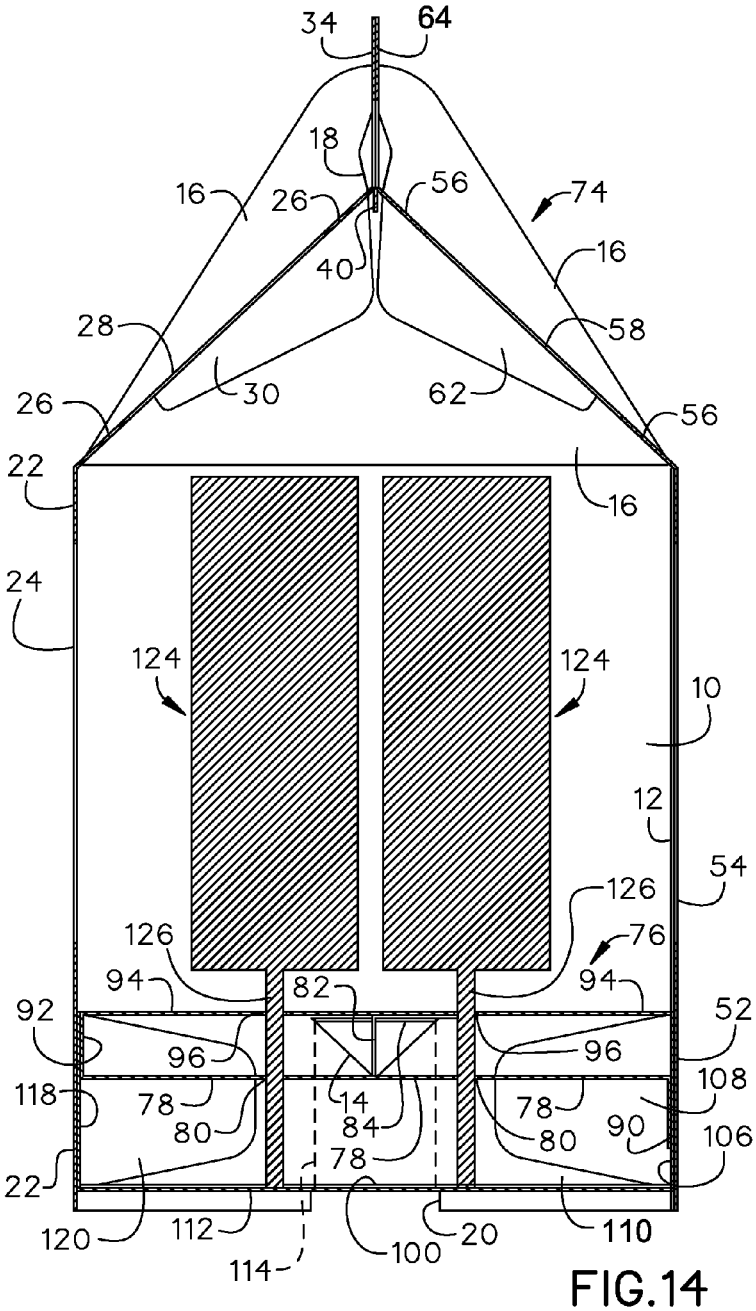
FIG. 14 is a section view of an exemplary embodiment of the present invention along line 14-14 in FIG. 12.

As is illustrated in FIGS. 1 through 14, a base tray 76 may include an upper level panel 94, at least one middle level panel 78 and a lower level panel 112. All panels of the base tray 76 may be connected. The upper level panel 94 may have a plurality of upper level panel holes 96. The upper level panel 94 may also have an upper level panel first side flap 98 and an upper level panel second side flap 102. The middle level panel 78 and the upper level panel 94 may connect through a first intermediate panel 92. The middle level panel 78 may have a top side and a plurality of middle level panel holes 80. At least one support may attach along the top side of the middle level panel 78. In certain embodiments, the at least one support may include a first side first support arm 82, a first side second support arm 84, a second side first support arm 86, and a second side second support arm 88. A second intermediate panel 106 may connect to the upper level panel 94 and the lower level panel 112. The second intermediate panel 106 may include a plurality of tabs 108,110. The plurality of tabs 108, 110 may include a first intermediate panel 108 and a second intermediate panel 110. The lower level panel 112 may include a plurality of securement tabs 114, 116 such as a first securement tab 114 and a second securement tab 116.

In certain embodiments, the middle level panel 78 may include a middle level panel secondary flap 90. The upper level panel 94 may also have a upper level panel first side secondary flap 100 and an upper level panel second side secondary flap 104. The lower level panel 112 may also include a side flap 118 having a plurality of side flap tabs 120, 122, such as a first lower level panel side flap 120 and a second lower level panel side flap 122.

A container 74 may include a first side panel 10, a second side panel 42, a front panel 22 and a rear panel 52. The first side panel 10 and the second side panel 42 may each have a securement hole, and an upper flap having an upper flap securement hole. The first side panel 10 may have a first securement hole 14 and a first upper flap 16 having a first upper flap securement hole 18. The second side panel 42 may have a second securement hole 46 and a second upper flap 48 having a second upper flap securement hole 50. The first side panel 10 may have a first lower notch 20 along a bottom edge. The second side panel 42 may have a second lower notch 44 along a bottom edge. The front panel 22 may connect to the first side panel 10 and the second side panel 42. The front panel 22 may have a front panel window 24. The rear panel 52 may be connected to the second side panel 42 and removably connected to the first side panel 10. The rear panel 52 may have a rear panel window 54. In certain embodiments the first side panel 10 may connect to a side panel flap 12. The front panel 22 and the rear panel 52 may each include a container upper flap 26, 56 respectively having an upper flap window 28, 58. The container upper flaps 26, 56 may include a front panel upper flap 26 and a second panel upper flap 56. The upper flap windows 28, 58 may include a container front panel upper flap window 28 and a container rear panel upper flap window 58. Each container upper flap 26, 56 may also connect to a plurality of upper flap side flaps; a first container front panel upper flap side flap 30, a second container front panel upper flap side flap 32, a first container rear panel upper flap side flap 60, a second container rear panel upper flap side flap 62. Each container upper flap 26, 56 may also include a handle 34, 64 having handle side tabs 36, 38, 66, 68. The front panel upper flap 26 may include the handle 34 having a first front handle panel side tab 36 and a second front handle panel side tab 38. The rear panel upper flap 56 may include the handle 64 having a first rear handle panel side tab 66 and a second rear handle panel side tab 68. In certain embodiments, along the front panel handle 34 may be a front panel handle window tab 40. Along the rear panel handle 64 may be a first rear panel handle window tab 70 and a second rear panel handle window tab 72.

A method of making the present invention may include the following. The base tray 76 and the container 74 may be made from paperboard, plastic or the like. The base tray 76 and the container 74 may be folded along score lines that connect each panel. To further secure the components together, glue or the like may be used to keep the panels in place once folded. The window portions 24, 54, 28, 58 of the container 74 may be attached to the panels 26, 22, 56, 52.

A method of using the present invention may include the following. The base tray 76 may be folded so that the base tray 76 roughly forms a box with the upper level panel holes 96 exposed as is shown in FIGS. 7 through 10. After erecting the base tray 76, sticks 126 with treats 124 placed on sticks 126, may be inserted into the plurality of upper level panel holes 96 and the plurality of middle level panel holes 80. Multiple layers of panels, such as the upper level panel 94, the middle level panel 78, and the lower level panel 112, may allow for the sticks 126 to be removably secured in the upright position displaying the treats 124. The sticks 126 may be placed in patterns, random order or the like, in order to allow for adequate space between the treats 124. Once the desired amount of treats 124 are removably secured within and on the base tray 76, the container 74 may be removably secured to the base tray 76. The container 74 may be folded to roughly form a hollow housing as is shown in FIGS. 2 through 6. The container 74 may be placed over the base tray 76. The plurality of securement tabs 114, 116 may be placed within the securement holes 46, 14 respectively. The securement tabs 114, 116 may be removably secured in place to secure the container 74 over the base tray 76. In certain embodiments, the first securement tab 114 may be positioned within the second lower notch 44 and the second securement tab 116 may be positioned within the first lower notch 20. The placement of the securement tabs 114, 116 within the lower notches 20, 44 may prevent pinching of the container 74 material. The container 74 may be removed from the base tray 76 to access the contents. The base tray 76 and container 74 may be removed and connected back together repeatedly without damage to the packaging. Transportation of the packaging may occur through a user picking up the invention by the handles 34, 64. The treats 124 may be viewed through the window portions 24, 54, 28, 58 of the container 74. The treats 124 may also be viewed with the container 74 removed.

A top of the container 74 may be closed by folding in each container upper flap 26, 56. The upper flaps 16, 48 of the first side panel 10 and the second side panel 42 may be bent towards the center of the invention. In certain embodiments, the handle side tabs 36, 38, 66, 68 may be positioned within the first upper flap securement hole 18 and the second upper flap securement hole 50.

It should be understood, of course, that the foregoing relates to exemplary embodiments of the invention and that modifications may be made without departing from the spirit and scope of the invention as set forth in the following claims.

What is claimed is:

1. A packaging for the protection and display of treats comprising:

a base tray comprising:

an upper level panel having a plurality of upper level panel holes, wherein the upper level panel has an upper level panel first side flap and an upper level panel second side flap;

at least one middle level panel having a top side and a plurality of middle level panel holes, wherein the top side of the middle level panel has at least one support, wherein the middle level panel connects to the upper level panel by a first intermediate panel; and a lower level panel connected to the upper level panel by a second intermediate panel, wherein the lower level panel comprises a plurality of securement tabs, wherein the secondary intermediate panel comprises a plurality of tab; and a container comprising:

a first side panel and a second side panel each having a securement hole, wherein the first side panel and the second side panel each have an upper flap having an upper flap securement hole;

a front panel connected to the first side panel and the second side panel, wherein the front panel has a front panel window;

a rear panel connected to the second side panel and removably connected to the first side panel, wherein the rear panel has a rear panel window, wherein the securement tabs of the base tray removably attach to the securement holes of the container.

2. The packaging for the protection and display of treats of claim 1, wherein the at least one support comprises a first side first support arm, a first side second support arm, a second side first support arm, and a second side second support arm.

3. The packaging for the protection and display of treats of claim 1, wherein the middle level panel further comprises a middle level panel secondary flap.

4. The packaging for the protection and display of treats of claim 1, wherein the upper level panel further comprises an upper level panel first side secondary flap and an upper level panel second side secondary flap.

5. The packaging for the protection and display of treats of claim 1, wherein the lower level panel further comprises a side flap having a plurality of side flap tabs.

6. The packaging for the protection and display of treats of claim 1, wherein the first side panel further comprises a container side panel flap.

7. The packaging for the protection and display of treats of claim 1, wherein the front panel and the rear panel each further comprise a container upper flap having an upper flap window.

8. The packaging for the protection and display of treats of claim 7, wherein each container upper flap has a plurality of upper flap side flaps.

9. The packaging for the protection and display of treats of claim 8, wherein each container upper flap further comprises a handle having handle side tabs.

* * * * *